United States Patent [19]

McGraw et al.

[11] 4,258,7

[45] Mar. 31, 19

[54] OIL WELL TESTING STRING BYPASS VALVE

[75] Inventors: Thomas E. McGraw, Caracas, Venezuela; John C. Zimmerman, Duncan, Okla.

[73] Assignee: Halliburton Company, Duncan, Okla.

[21] Appl. No.: 39,490

[22] Filed: May 16, 1979

[51] Int. Cl.[3] ..... E21B 33/10; E21B 47/00

[52] U.S. Cl. ..... 166/315; 137/535; 166/323; 166/326; 251/318; 251/337

[58] Field of Search ..... 166/315, 264, 321, 326, 166/323; 251/318, 337; 137/535, 540

[56] References Cited

U.S. PATENT DOCUMENTS

| | | | |
|---|---|---|---|
| 2,251,977 | 8/1941 | Burt . | |
| 2,644,526 | 7/1953 | Lee | 166/326 |
| 3,053,322 | 9/1962 | Kline | 166/326 |
| 3,193,016 | 7/1965 | Knox | 166/325 |
| 3,583,481 | 6/1971 | Vernotzy | 166/156 |
| 3,750,752 | 8/1973 | Mott | 166/323 |
| 3,814,182 | 6/1974 | Giroux | 175/318 |
| 3,858,649 | 1/1975 | Wray et al. | 166/162 |
| 4,063,593 | 12/1977 | Jessup | 166/264 |
| 4,064,937 | 12/1977 | Barrington | 166/162 |

*Primary Examiner*—James A. Leppink
*Attorney, Agent, or Firm*—John H. Tregoning; James Duzan; Floyd A. Gonzalez

[57] ABSTRACT

An improved bypass valve for use with an oil v testing string is disclosed which includes a check va means for allowing fluid flow from the interior of test string to the well annulus when the interior press exceeds the well annulus pressure. The bypass va further includes a blocking means which blocks inte communication with the check valve means when well annulus pressure exceeds the string interior p sure. A delay means is included which delays the act of the blocking means for a predetermined length time. The improved bypass valve is intended for us a testing string for an oil well, and is to be placed in testing string below a normally closed tester valve above a seal assembly for insertion into sealing enga ment with a preset production type packer. The t delay allows the seal assembly to be removed from packer after the packer location is determined with activating the blocking means to move to its loc closed position.

10 Claims, 7 Drawing Figures

OIL WELL TESTING STRING BYPASS VALVE

BACKGROUND OF THE INVENTION

Figure 1:
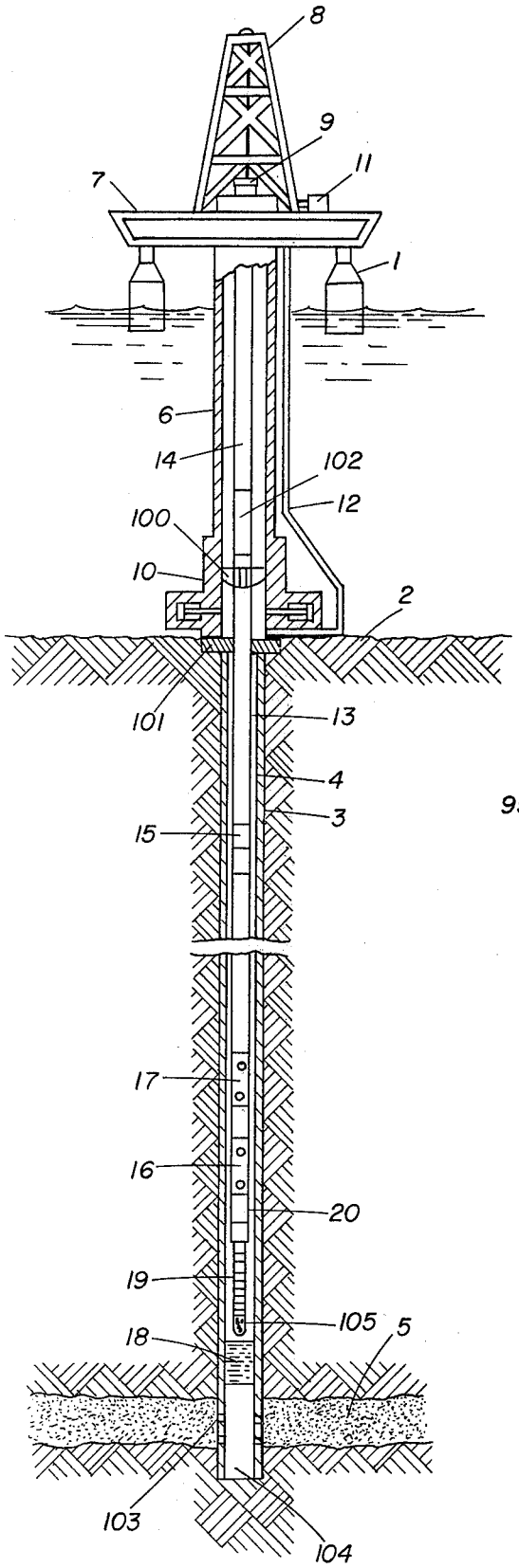

This invention relates to an apparatus for use with a tubing string used in conducting drill stem tests of oil and gas wells. More particularly, the apparatus relates to a check valve apparatus allowing trapped fluid to flow from the interior of the test string to the well annulus when the testing string is being lowered in a well bore into sealing engagement with a wireline set production type packer.

During the drilling of oil and gas wells, drilling fluid known as mud is used, among other things, to maintain formation fluids in intersected formations by virtue of its hydrostatic pressure. In order to allow the formation fluids to flow to the surface for analysis, it is necessary to isolate the formation to be tested from the hydrostatic pressure of the drilling fluid in the well annulus. This is done by lowering a tubular string to the formation to be tested, and then sealing the well annulus between the tubular string and above the formation with a packer.

Typically a tester valve is included at the lower end of the tubular string and is lowered in the closed condition such that a lower pressure exists in the center bore of the tubular string. After the formation is isolated from the well annulus, the tester valve is opened to lower the pressure in the well bore adjacent the formation to be tested such that formation fluids may flow from the formation into the lower end of the tubular string and from there to the surface.

Pressure sensors are typically included in the test string such that the tester valve may be opened and closed and pressure recordings made to evaluate the production potential of the formation being tested.

Two types of packers may be used. The first type is a packer which may be incorporated in a tubular string and expanding by manipulation of the tubing string to effect the seal between the walls of the well bore and the tubular testing string. A second type is a wireline set production packer which is lowered and attached to the walls of the well bore at the desired location. The tubular string having a seal assembly at its lower end, is then lowered into the well bore until the seal assembly is seated in the production type packer to effect the seal necessary to isolate the formation.

It will be understood that if a production type packer is used, fluid trapped in the well bore below the production packer will be compressed as the tubular string is further lowered into place after the seal assembly has effected its seal in the production packer. This fluid trapped in the well bore below the packer must be displaced back into the formation as the seal assembly is further lowered into the packer. The displacement of drilling fluid into the formation is undesirable in that it may seal or otherwise damage the pore spaces in the formation through which oil and gas must be produced. Also, if an annulus pressure operated well tester valve having a pressure operated isolation valve such as that disclosed in U.S. Pat. No. 3,964,544 or U.S. Pat. No. 3,976,136 is used, the compression of fluid in the central bore of the well string below the tester valve will increase the operating pressure of the tester valve to an undesirably high level.

The use of the disclosed emodiments prevents high pressure from the trapped fluid from developing which might otherwise damage the packer, the pressure recorder, the tester valve, or other tools in the testin string. Also, this trapped fluid might support the testin string and prevent its downward movement to com pletely seat in a hanger. When a tester valve in th testing string is subsequently opened, the trapped flui will be released allowing the testing string to fall whic may in turn damage the tubing of the string or th hanger.

In the disclosed embodiments of the present inver tion, a check valve means is provided below the teste valve and above the seal assembly at the lower end c the testing string, and is designed to allow compresse fluid in the central bore of the testing string below th closed tester valve to escape to the well annulus abov the packer. When the well annulus pressure is increase to operate tester valves such as those disclosed in th aforementioned U.S. Pat. Nos. 3,964,544 and 3,976,13 the check valve prevents pressure from increasing i the testing string central bore, and a blocking mech nism is activated to block the check valve means in closed position. The blocking means is then locked i the closed position such that treating operations of th formation as disclosed in U.S. Pat. No. 3,976,136, ma be conducted wherein specialized chemicals, such as a acid, may be displaced into the formation without e caping into the well annulus through the check valve The invention disclosed makes the use of annul pressure operated testing apparatus in combination wit a production type packer more efficient in that th pressure level necessary to operate the testing tools not unduly raised, and the operation of the tools is n otherwise affected.

It is common practice when a production packer used, to lower the testing string into the well bore unt the packer is "tagged" by setting a portion of the testin string weight down on the packer. The change i weight indication at the surface as a result of tagging t packer is used to determine the exact location of t packer.

The testing string is then withdrawn a sufficie amount so that a hanging device may be installed in t string. This hanging device is used to support t weight of the testing string such that the seal assembl is engaged with the packer without an undue amount weight being supported by the packer.

A delay mechanism controls the rate at which t blocking means moves to the fully closed position order that the seal assembly may be removed from t packer during this process without the blocking mea moving to the locked closed position.

Also disclosed is a check valve which allows drillin mud to flow from the interior flow channel of the tes ing string to the well annulus without clogging t check valve mechanism.

THE DRAWINGS

A brief description of the appended drawings fc lows:

FIG. 1 provides a schematic "vertically sectione view of a representative offshore installation which m be employed for formation testing purposes and illu trates a formation testing "string" or tool assembly as is being lowered into a submerged well bore to the poi just before the seal assembly enters a production ty packer, and with the testing string extending upward to a floating operating and testing station.

Figure 2:
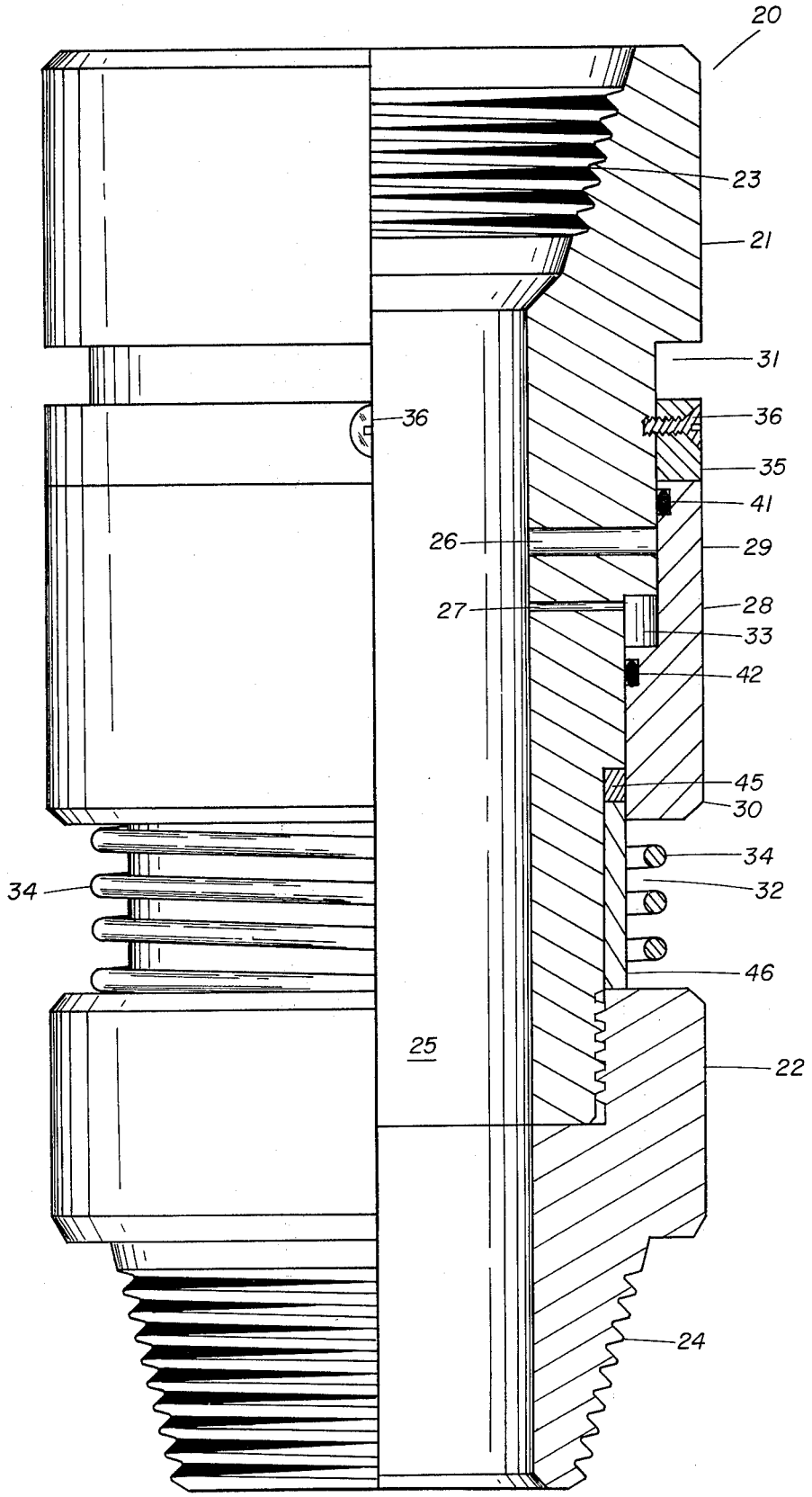

FIG. 2 provides a "vertically sectioned" elevational :w of a preferred embodiment of the invention show- ; a check valve means, a shear means for setting the erating pressure of the assembly, and a locking :ans.

FIGS. 3*a*–3*d* joined along section lines a—a, b—b, d c—c provide a "vertically sectioned" elevational :w of a preferred embodiment of the invention show- ; a check valve means having a radially extensible ɔber sleeve, a closing means for closing the check lve means when well annulus pressure is increased, a lay means for delaying the closing of the check valve :ans, and a locking means for locking the closing :ans in the closed position.

Figure 4:
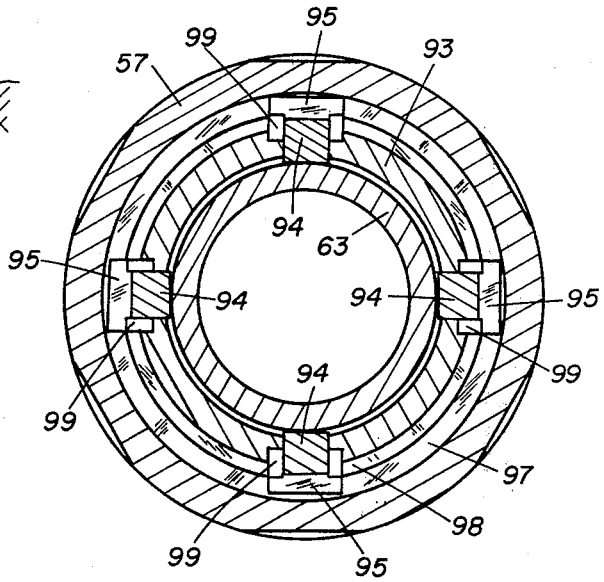
Figure 3A:
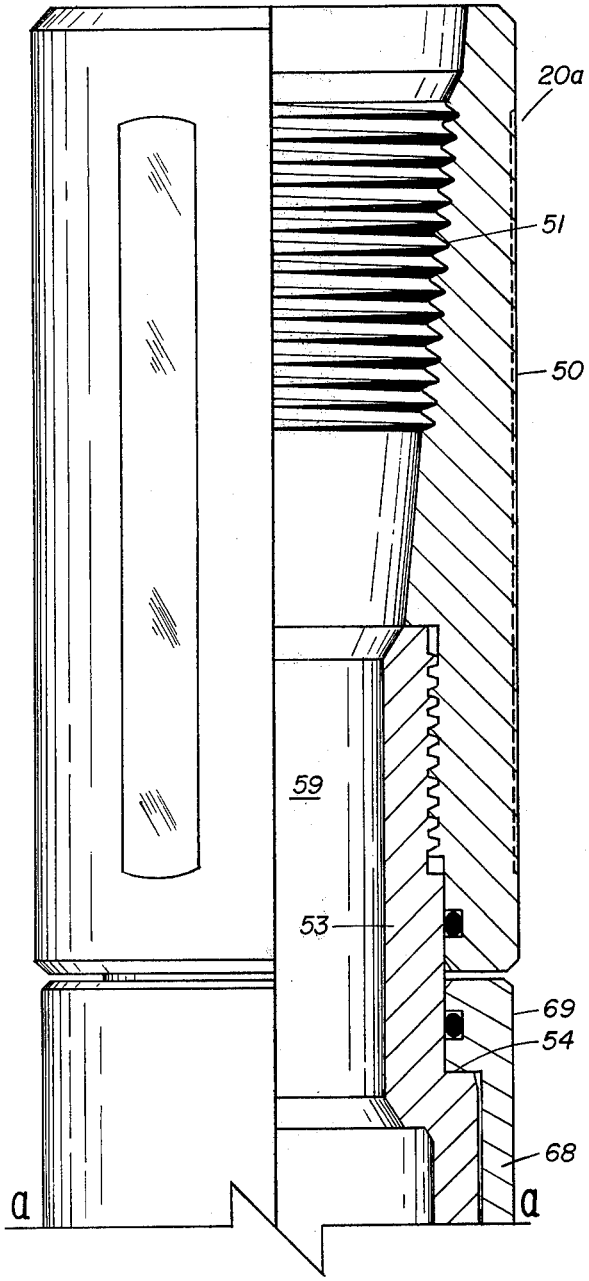
Figure 3B:
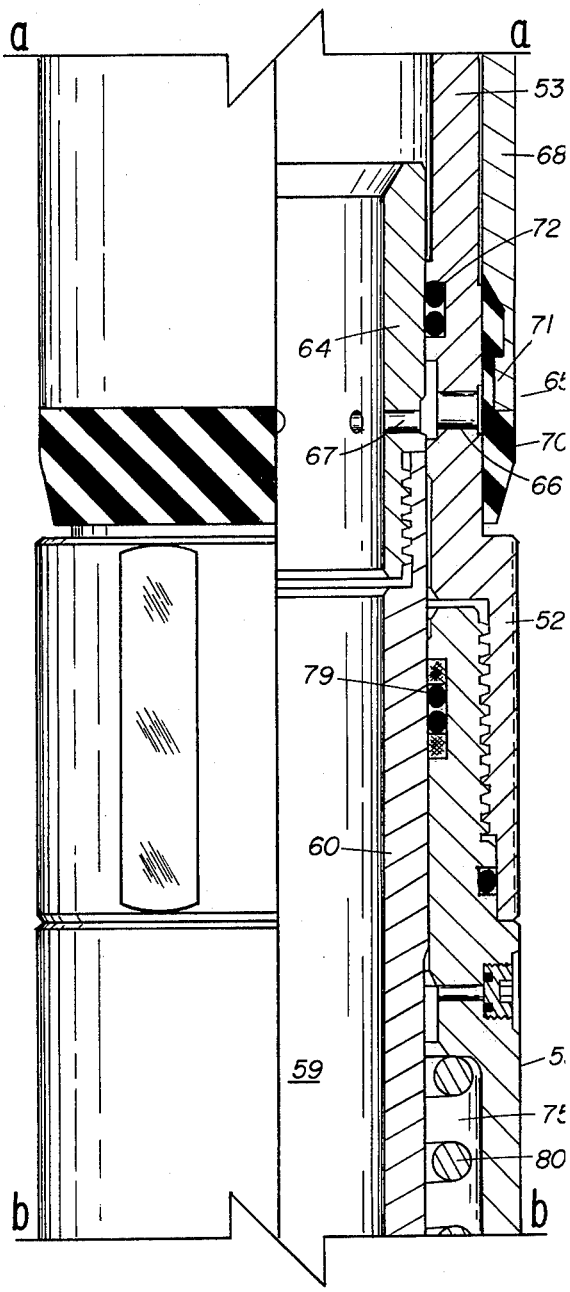
Figure 3C:
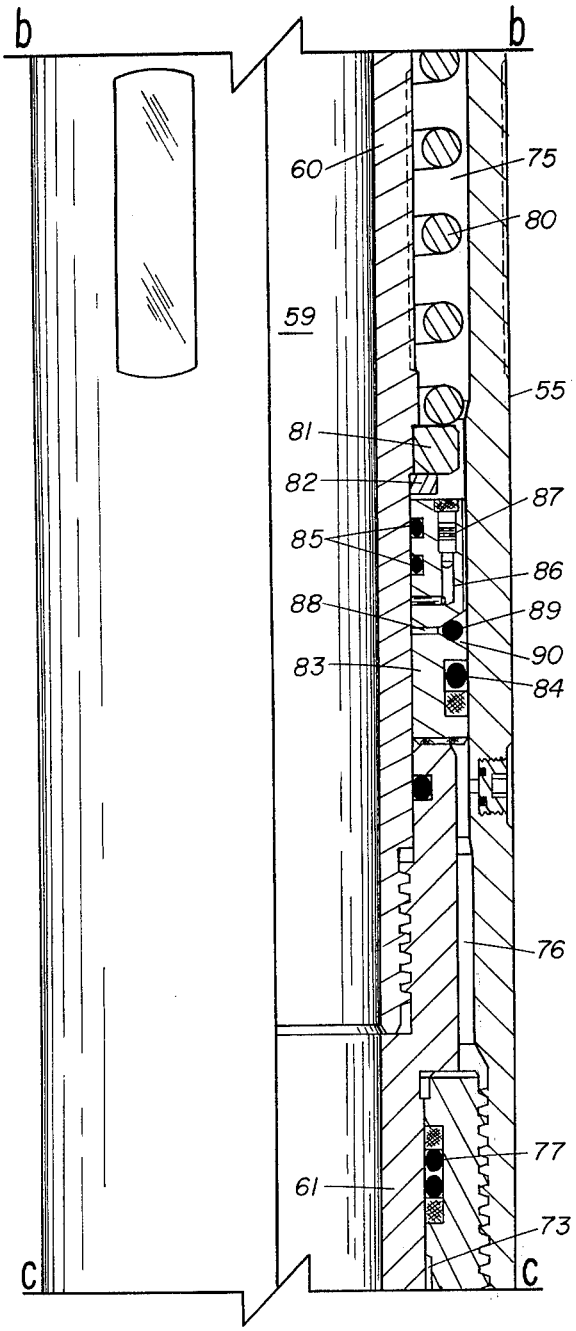
Figure 3D:
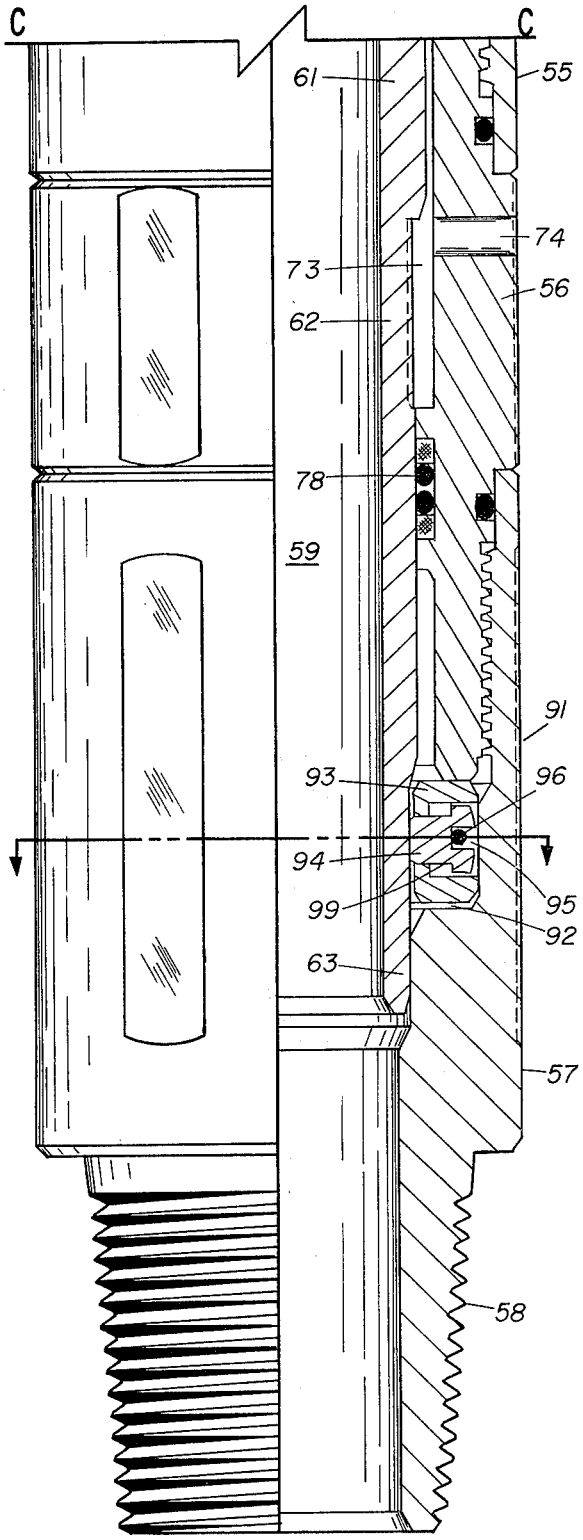

FIG. 4 is a cross-sectional view of the apparatus of GS. 3*a*–3*d* taken along section line 4—4 of FIG. 3*d* ɔwing details of the locking means.

ENVIRONMENT

The apparatus of the present invention may be used th a testing string for offshore oil wells as illustrated FIG. 1.

In FIG. 1 is shown a floating work station 1 centered er a submerged oil well located on the sea floor 2 and ving a borehole 3 which extends from the sea floor 2 a submerged formation 5 to be tested. The borehole s typically lined by a steel liner 4 cemented into place. subsea conduit 6 extends from the deck 7 of the float- ; work station 1 to a well head installation 10. The ıating work station 1 has a derrick 8 and a hoisting paratus 9 for raising and lowering tools to drill, test d complete the oil well.

Illustrated in FIG. 1, a testing string 14 is being low- ɜd into place in the borehole 3 of the oil well. The ıting string 14 includes such tools as a slip joint 15 to mpensate for the wave action of the floating work ıtion 1 as the testing string is being lowered into place, :ester valve 16 and a circulation valve 17.

The slip joint 15 may be similar to that described in S. Pat. No. 3,354,950 issued to Hyde on Nov. 28, 67. The tester valve 16 may be one of the annulus essure responsive type and is preferably one of the full ıening types such as described in U.S. Pat. No. 356,085 issued to Holden et al Dec. 24, 1974, or that scribed in U.S. Pat. No. 3,976,136 issued to Farley et Aug. 24, 1976, or that described in U.S. Pat. No. 964,544 issued to Farley et al June 22, 1976.

The circulation valve 17 is preferably of the annulus essure responsive type and may be that described in S. Pat. No. 3,850,250 to Holden et al issued Nov. 26, 74, or may be a combination circulation valve and mple entrapping mechanism similar to those disclosed U.S. Pat. No. 4,063,593 issued to Jessup Dec. 20, 77, or U.S. Pat. No. 4,064,937 issued to Barrington ec. 27, 1977. The circulation valve 17 may also be the closable type as disclosed in U.S. Pat. No. 4,113,012 ıued to Evans et al Sept. 12, 1978.

As described in the aforementioned U.S. patents, ıth the tester valve 16 and the circulation valve 17 are ıerated by annulus pressure exerted by a pump 11 on e deck of the floating work station 1. Pressure ıanges are transmitted by a conductor pipe 12 to the ell annulus 13 between the casing 4 and the testing ·ing 14. Well annulus pressure is isolated from the rmation 5 to be tested by a packer 18 set in the well sing just above the formation 5. The check valve sembly 20 of the present invention is located in the sting string 14 below the tester valve 16. This check valve assembly 20 is most advantageously used with a permanent production type packer 18 which, for instance, may be the Baker model D packer, the Otis type W packer or the Halliburton EZ DRILL ® SV packer. Such packers are well known in the oil well testing art.

The testing string 14 includes a tubing seal assembly 19 at the lower end of the testing string 14 which stabs through a passageway through the production packer 18 for forming a seal isolating the well annulus 13 above the packer 18 from an interior bore portion 104 of the well immediately adjacent the formation 5 and below the packer 18.

A perforated tail piece 105 or other production tube is located at the bottom end of the seal assembly 19 to allow formation fluids to flow from the formation 5 into the flow passage of the testing string 14. Formation fluid is admitted into well bore portion 104 through perforations 103 provided in the casing 4 adjacent formation 5.

A formation test controlling the flow of fluid from the formation 5 through the flow channel in the testing string 14 by applying and releasing annulus pressure to the well annulus 13 by the pump 11 to operate the tester valve 16 and the circulation valve assembly 17 and measuring the pressure build-up curves with appropriate pressure sensors in the testing string 14 as fully described in the aforementioned patents.

The testing string 14 is lowered into the oil well bore 3 by the hoisting means 9 until a fluted hanger 100 is in supporting contact with a supporting pad means 101 at the sea floor 2. Above the fluted hanger 100 is a subsea test tree 102 which may be, for instance, the pressure operated subsea test tree disclosed in U.S. Pat. No. 4,116,272 issued to Barrington Sept. 26, 1978, or may be the hydraulically operated subsea test tree available from Otis Engineering Corporation of Dallas, Texas.

One common way of locating the fluted hanger 100 at the proper location in the testing string 14, is to lower the testing string 14 without the hanger into the oil well bore 3 until the seal assembly 19 is fully inserted into the packer 18 and the bottom end of the testing string 14 rests on top of the packer 18. This event is indicated at the surface by a reduction in the weight of the testing string 14 as more and more of the weight is supported by the packer 18. The testing string 14 is then marked, and the testing string 14 is removed sufficiently such that the fluted hanger 100 may be installed in the testing string 14 at the proper distance below the mark such that when the testing string 14 is re-lowered into the oil well bore 3, the fluted hanger 100 rests on the pad means 101 and the sealing means 19 will be inserted into the packer 18 but without the weight of the testing string 14 being supported by the packer 18.

It can be seen that when the sealing means 19 is inserted into the packer 18, fluid will be trapped in central bore portion 104. This trapped fluid must be displaced back into the formation as the sealing means 19 is inserted further into the interior bore 104. It will also be understood that movement of the sealing means 19 and the perforated tail piece 105 into the interior bore 104 will cause the pressure in the interior bore portion 104 to rise, thus increasing the pressure necessary to operate a pressure operated isolation valve used in tester 16, if a tester valve such as that disclosed in U.S. Pat. No. 3,964,544 is used.

The check valve assembly 20 of the present invention is installed below the tester valve 16 for allowing trapped formation fluid in interior bore portion 104 to move into the well annulus 13 as the sealing assembly 19 is pushed further and further into interior bore portion 104. This prevents the excessive build-up of pressure in the interior of the testing string 14 below the tester valve 16 and also prevents drilling mud in interior bore portion 104 from being pushed into the formation 5 as the testing string 14 is lowered during its last increment of travel into place.

PREFERRED EMBODIMENTS

One of the preferred embodiments is shown as check valve assembly 20 in FIG. 2. The check valve assembly 20 has an upper outer casing 21, a lower outer casing 22, and an interior bore 25 for communication with the flow passage through the testing string.

Threads 23 are provided in upper outer casing 21 to join the assembly 20 to the testing string for instance under the tester valve as discussed in connection with FIG. 1 and shown in U.S. Pat. No. 3,976,136 issued Aug. 24, 1976 to Farley et al or the tester valve shown in U.S. Pat. No. 3,964,544 issued June 22, 1976 to Farley et al. Threads 24 are provided in the lower outer casing 22 for use in installing the assembly 20 into the testing string as discussed in connection with FIG. 1.

A flow passage 26 and a pressure passage 27 are provided through the upper outer casing 21. Communication through the flow passage 26 is controlled by a check valve which has a sliding valve mandrel 28 which includes an upper sleeve portion 29 and a lower collar portion 30. The upper sleeve portion 29 covers flow passage 26 when the sliding valve mandrel 28 is in its normal uppermost position.

A cutout portion 31 is provided in upper outer casing 21 to receive the upper sleeve portion 29, and a lower cutout portion 32 is provided to receive the collar portion 30 of sliding valve mandrel 28. The shoulder between cutout portion 31 and cutout portion 32 provides a chamber 33 between casing 21 and the sleeve portion 29 and collar portion 30 of sliding valve mandrel 28. This chamber portion 33 communicates with the pressure passage 27 thereby communicating with the interior bore 25 of the assembly 20.

A spring means 34 is provided in cutout portion 32 and resiliently urges sliding valve mandrel 28 in the upward direction. A stop collar 35 is frangibly held in place by shear screws 36 to stop the upward movement of valve mandrel 28 until a predetermined force, as set by the shear screws 36, is exceeded in the upward direction. Sealing means, such as O-rings 41 and 42, are provided between the sliding valve mandrel 28 and the outer casing 21 as shown in FIG. 2 such that when the valve mandrel 28 is in its normal position, the flow passage 26 and pressure passage 27 are closed to prevent communication between the interior bore 25 and the well annulus surrounding the valve assembly 20.

It can be seen that if the pressure in the interior bore 25 exceeds the pressure in the well annulus, that this interior pressure will be communicated by passage 27 to the chamber means 33 to supply a downward force to the sliding valve mandrel 28. When the pressure differential is sufficient to overcome the force supplied by spring 34, the sliding valve mandrel 28 will move downwardly until flow passage 26 is opened allowing fluid to flow from the interior bore 25 to the well annulus surrounding the valve assembly 20. This flow will lower the interior pressure in bore 25 a sufficient amount such that spring 34 may again slide the sliding valve mandrel 28 upwardly until the sleeve portion 29 again covers flow passage 26 and the interior bore 25 is sealed frc communication with the well annulus surrounding t valve assembly 20 by O-ring seals 41 and 42.

When the well annulus pressure is raised to opera the other well annulus pressure responsive tools in t testing string as described in connection with FIG. 1, upwardly directed force will be generated due to t higher pressure in the well annulus as compared wi the pressure in the central bore 25 of the valve assemb 20. When this upwardly directed force is sufficient shear the shear screws 36 in the shear collar 35, t sliding valve mandrel 28 will move upwardly to uppermost locked position.

A snap ring 45 is provided trapped between the coll portion 30 of the sliding valve mandrel 28 and the out case 21 of the valve assembly 20 and sleeve 46. Sn ring 45 locks the valve mandrel in the uppermost po tion to lock flow passage 26 closed when collar porti 30 of valve mandrel 28 moves upwardly sufficiently uncover the snap ring 45. Thus, if the interior pressu 25 is increased over the annulus pressure, such as in acidizing or well treating application as described connection with the tester valve disclosed in U.S. P No. 3,964,544, the sliding valve mandrel 28 will not moved to the opened position.

The sleeve 46 is sized to allow the collar portion 30 the sliding valve mandrel 28 to move freely upward and downwardly as previously described. If desired, t sleeve 46 could be fabricated as a part of the upper out casing 21.

In operation, the assembly 20 is incorporated into testing string with a tester valve 16, such as that d closed in the aforementioned U.S. Pat. No. 3,964,54 the entire specification of which is incorporated here by reference, to open and close the flow passa through the testing string 14 from the formation 5 to t work station 1.

A further flow passage 26 is provided through t housing 21 of the total 20 from the longitudinal passa through the testing string which includes the bore through the tool 20, to the annulus 13 of the well. Tl further flow passage 26 is blocked by the upper porti 29 of the sliding valve mandrel 28. This valve mandı 28 is part of a check valve arrangement which is ope ated by a differential pressure between the inner bore and well annulus 13. When the pressure in the bore 25 higher than the pressure in the well annulus 13 by amount sufficient to overcome the spring 34, the val mandrel 28 moves to the open position.

When the well annulus pressure is equal to the pre sure in the bore 25, the valve mandrel 28 moves to t closed position. When the well annulus pressure is i creased to operate the tester valve 16 and is higher th the pressure in bore 25 by an amount sufficient to she the shear screws 36, the valve mandrel 28 moves to locked closed position.

A second preferred embodiment of the invention shown as apparatus **20*a* in FIGS. 3*a* through 3*d*. T apparatus 20*a* includes an outer housing assembly ha ing an upper housing member 50 having interior threa 51 for attaching the apparatus 20*a* into a testing stri above the apparatus, a check valve housing member having an upper extension 53 which includes a should portion 54 to be explained later, a metering chamb housing 55, an intermediate housing 56, and a low housing 57 having a lower threaded extension 58 f attaching the apparatus 20*a*** into a testing string belc the apparatus. The tubular housing assembly has ior bore 59 passing through the entire apparatus ithin the tubular housing assembly is an inner slid-mandrel assembly having an inner sliding mandrel an upper extension 64 threadably attached to the er end of the sliding mandrel 60, and a piston man- 61 including a reduced portion 62 and a lower end he apparatus 20*a* includes a check valve means 65 ng a plurality of check valve ports 66 through the ck valve housing member 52 and communicating a plurality of lateral ports 67 through the upper nsion 64 of the inner sliding mandrel assembly. A ck valve sleeve 68 is positioned over the upper ex- ion 53 of the check valve housing 52 and has a ar 69 which is trapped between the shoulder 54 of nsion 53 and the lower end of the upper housing nber 50 as shown in FIG. 3*a*. This arrangement rely holds in place the check valve sleeve 68.

rubber skirt 70 is positioned over the check valve s 66 as shown in FIG. 3*b* and held in place by lip 71 he lower end of check valve sleeve 68. This rubber t 70 is provided to allow fluid passage from the inner 59 to move through communicating ports 67 and into the area exterior of the assembly 20*a*, while venting fluid flow from the well annulus exterior of mbly 20*a* into the interior bore 59 through the men- ed ports 66 and 67.

sealing means 72 is provided between the extension of check valve housing member 52 and the upper nsion 64 of the inner sliding mandrel assembly and esigned to provide a seal between the housing exten- 53 and the inner sliding mandrel member 60 when inner sliding mandrel assembly moves upwardly to closed position.

power chamber 73 shown in FIG. 3*d* is provided ween the intermediate housing member 56 and the ver piston mandrel 61 of the inner sliding mandrel mbly. A power port 74 through the intermediate sing member 56 provides communication from the l annulus exterior of the assembly 20*a* with the ver chamber 73.

n oil filled chamber shown in FIG. 3*c* is provided ween the metering chamber housing member 55 and inner sliding mandrel member 60 and is divided into upper portion 75 and a lower portion 76. The lower l of the lower oil filled chamber portion 76 is sealed sealing means 77. Sealing means 78 shown in FIG. 3*d* provided in the lower end of power chamber 73 and a smaller radius than the radius of sealing means 77 provide an annular piston in piston mandrel 61 such t well annulus pressure which is higher than the ssure in the interior bore 59 of the apparatus 20*a* will e the piston mandrel 61 and the connected inner ling mandrel assembly upwardly.

An upper sealing means 79 shown in FIG. 3*b* is pro- ed between the sliding mandrel member 60 and the tering chamber housing 55 to seal the upper end of oil filled chamber portion 75.

A mechanical spring 80 is provided in the oil filled mber portion 71 to urge the inner sliding mandrel wnwardly to a normally open position allowing fluid nmunication to flow through communicating ports and 66. A pillow ring 81 is provided in sliding man- l member 60 to compress the spring 80 when the er sliding mandrel assembly moves upwardly. A aining ring 82 holds pillow ring 81 in position. A tering piston means 83 is trapped between the retaining ring 82 and the upper end of power piston mandrel 61 and includes sealing means 84 and 85 to separate the upper oil filled chamber 75 from the lower oil filled chamber 76.

A metering passage 86 is provided through the metering piston means 83 as shown in FIG. 3*c*. The metering passage 86 includes a metering means 87 such as a Lee Visco jet available from the Lee Company of Westbrook, Connecticut. This metering means is provided for controlling the rate of oil passage from the upper chamber 75 to the lower chamber 76 to control the movement of the inner sliding mandrel assembly in the upward direction. A bypass means including a bypass passage 88, an O-ring 89, and a V-groove 90 in the metering piston means 83 is provided to provide a means of bypassing oil around the metering means 87 when the inner sliding mandrel assembly is moving in the downwardly direction.

A locking means 91 shown in FIG. 3*d* is provided in the lower end of assembly 20*a* and includes a locking means cavity 92 between the lower housing member 57 and the lower end 63 of the power piston mandrel 61. Located in the cavity 92 is a ring member 93 having a plurality of plugs 94 spaced in stepped holes 99 around its periphery. Each locking plug 94 includes a groove 95. An O-ring 96 is stretched around the locking plugs in the ring member 95 for providing an inwardly directed force against each plug.

The operation of the locking means can better be understood by referring to FIG. 4 which is a transverse section of the apparatus 20*a* taken along section line 4—4 of FIG. 3*d*. The O-ring 96 has been omitted from FIG. 4 for the sake of clarity.

The ring member 93 has a groove 97 aligned with the groove 95 in the locking plugs 94 for receiving the O-ring 96. A more inward groove 98 is provided in ring member 93 for allowing the O-ring 96 to move radially inwardly moving the locking plugs 94 to the bottom of the stepped holes 99 when end 63 moves to the uppermost position.

It will be understood when the inner sliding mandrel assembly moves upwardly to block port 66, lower end 63 of the inner mandrel assembly will move upwardly until it clears the locking plugs 94 allowing the locking plugs to move inwardly to their seated position. When locking plugs 94 have moved inwardly, the inner sliding mandrel assembly may not move downwardly past the locking plugs 94 which will now extend into the interior bore 59 of the apparatus 20*a*.

It will be understood that when the apparatus 20*a* is substituted for the apparatus 20 in FIG. 1, and the tool is being lowered into the well bore 3, the pressure in the well annulus 13 will be equal to the pressure in the interior bore 59 of the apparatus 20*a*. Thus, while the tool is being lowered into place there will be no transfer of fluid through the communicating passages 66 and 67. When the testing string 14 is lowered sufficiently such that the seal assembly 19 is sealingly inserted into packer 18, the pressure in the interior bore 59 will begin to raise higher than the pressure in the well annulus 13 as the testing string is lowered further into the hole and well fluid trapped in the well bore portion 104 is compressed by the seal assembly 19 moving into portion 104. This higher pressure in the interior bore 59 will cause rubber skirt 70 to move radially outwardly to allow fluid to flow through ports 67 and 66 and into the well annulus 13. When enough fluid moves out of interior bore 59, the pressure in the interior bore 59 will again equal the well annulus pressure, and the rubber skirt 70 will move back to its closed position.

In this manner, well fluid will be removed from well bore portion 104 until the testing string is fully seated into place. When the testing string has been lowered sufficiently, a portion of the testing string weight is supported by the packer 18 and will be registered at the surface by a change in the "weight on hook" indication. The testing string will be marked at the surface 7 of the work station 1 and the testing string 14 will be removed from the well bore a sufficient distance such that the fluted hanger 100 may be installed at the proper location in the testing string. The testing string 14 is then once again lowered into the well bore 4 until the fluted hanger 100 comes to rest on the supporting pad means 101. The fluted hanger 100 is installed in the testing string 14 such that the weight of the testing string 14 below the hanger 100 will be supported by the hanger 100 with the sealing assembly 19 inserted into the packer 18.

It can be understood that when the testing string 14 is withdrawn from the well bore 4 to install the fluted hanger 100, the volume of the sealing assembly 19 and the perforated tail piece 105 will be removed from the well bore portion 104 of the well, and if well fluid is not replaced into the portion 194 the pressure in the interior bore 59 of the apparatus will be lower than the pressure in the well annulus 13. In the embodiment discussed in connection with FIG. 2, this lower pressure would cause the shear pins 36 to shear and the sleeve portion 29 to move upwardly and lock into place blocking flow passage 26. Thus the apparatus discussed in connection with FIG. 2 could not again be used to insert the sealing assembly 19 into the packer 18 after the fluted hanger 100 had been installed in the test string 14. In the apparatus 20*a* discussed in connection with FIGS. 3*a* through 3*d*, the metering means 87 in the metering piston 83 would control the movement of the inner sliding mandrel assembly in the upward direction when the interior bore pressure was lowered as described in connection with the installing of the fluted hanger 100. This delayed movement of the inner sliding mandrel assembly would be sufficient to allow the formation 5 to produce fluid to fill well bore portion 104 and allow removal of the sealing means 19 from the packer 18. The fluted hanger 100 could then be installed in the testing string 14 and the testing string 14 relowered into the well bore 4 until the fluted hanger 100 was supported by the pad means 101 as previously described.

The annulus pressure operated tester valve 16 may then be operated in the usual manner. When the well annulus pressure is raised to operate the tester valve 16, the inner sliding mandrel assembly would move upwardly at the metered rate until the sliding mandrel member 60 blocked the ports 66, and the lower end 63 passed the locking plugs 94. The locking plugs 94 would then move inwardly to lock the check valve means 65 in the closed condition for the remainder of the testing program. This locked closed condition would be further advantageous as well treating operations could be conducted by pumping various well treating fluids through the testing string and into the formation 5 thereby raising the pressure in the interior bore 59 with the check valve assembly 65 in the locked closed position. This treating operation is further described in connection with the tester valve 16 in U.S. Pat. No. 3,964,544.

The embodiment of FIGS. 3*a*–3*d* may be used with a long sealing assembly 105 to eliminate the necessity o slip joint 15. The action of the check valve means 65 anc the metering means 87 would allow the sealing assem bly 105 to move up and down in the packer 18 with the wave motion of the floating work station 1 while the testing string was being lowered into place withou closing the check valve means 65.

To review the operation of the embodiment of FIGS 3*a*–3*d*, the assembly 2*a* is incorporated into a testing string 14 such that the interior bore 59 of the apparatu forms part of the flow passage through the testing string from the formation 5 to the work station 1. This flow passage is controlled by the annulus pressure responsive tester valve 16 in the testing string.

A further flow passage through the tubing walls 52 o the apparatus 20*a* is provided by ports 66 intercon nected with ports 67 through upper extension 64. Thi further flow passage is controlled by a differential pres sure valve means comprising the radially extensible rubber skirt 70 located around the outer periphery o the apparatus over the ports 66 such that when the pressure in the central bore 59 is greater, the rubbe skirt is moved away from the ports 66 to allow fluic flow from the bore 59 into the well annulus 13. Wher the well annulus pressure is higher than the bore pres sure, the rubber skirt is sealed against the ports 66 sucl that fluid cannot flow from the well annulus 13 into the central bore 59.

When the well annulus pressure is held at an elevatec value for a sufficient length of time, the inner sliding mandrel assembly moves upwardly to seal the inwarc ends of the ports 66 in a locked closed position.

The scope of the protection afforded by the patent i to be measured by the appended claims, which claim are intended to cover the disclosed embodiments of the invention and all equivalent embodiments which fal into the spirit and the scope of the claims as may b envisioned by those skilled in the art.

What is claimed is:

1. In an apparatus for relieving fluid trapped betwee a preset packer and a closed tester valve in a drill sten testing string as the testing string is being seated in the preset packer, the improvement comprising:

check valve means in the walls of the apparatus fo relieving fluid from the interior of the apparatus t the exterior surrounding the apparatus when th interior fluid pressure exceeds the exterior pres sure, and for closing and preventing fluid flov from the exterior to the interior when the exterio fluid pressure exceeds the interior pressure;

slidable mandrel means in the interior of said appara tus responsive to the exterior pressure for sliding from a first open position wherein fluid access t said check valve means from the interior of sai apparatus is opened, to a second closed positio wherein fluid access to said check valve mean from the interior of said apparatus is blocked, sai slidable mandrel means having pressure responsiv means for moving said slidable mandrel mean from said first position to said second positio when said exterior pressure is increased; and delay means responsive to said slidable mandre means for delaying the movement of said slidabl mandrel means for a length of time after said exte rior pressure is increased.

2. The improvement of claim 1 wherein the walls c said apparatus contain port means from the interior c : apparatus to the exterior, and said check valve :ans comprises a rubber skirt around the periphery of d apparatus over said port means and fixed at one d, said rubber skirt arranged for radial expansion twardly allowing fluid flow through said port means ›m the interior of said apparatus to the exterior, and : sealing said port means when said exterior pressure at least equal to said interior fluid pressure.

3. The improvement of claim 1 wherein said appara- ; has a chamber in the walls thereof, and said delay :ans comprises:

an annular piston around the periphery of said slidable mandrel means dividing said chamber into upper and lower portions;

fluid in said upper and lower portions of said chamber; and metering means in said annular piston for transferring said fluid from one portion of said chamber to the other portion of said chamber at a metered rate as said annular piston moves through said chamber responsive to movement of said slidable mandrel means.

4. The improvement of claim 3 wherein said delay :ans further comprises bypass means for bypassing d metering means when said slidable mandrel means ›ves away from said second closed position toward d first open position, and spring means in one of said amber portions for urging said slidable mandrel :ans toward said first open position.

5. The improvement of claim 1 further comprising :cking means for locking said slidable mandrel means said second closed position.

6. An apparatus for use with a testing string in the rehole of a well, and extending from a formation to tested to the surface comprising:

a tubular housing having means at each end for incorporating said apparatus into a testing string, and having a power pressure port open to the well annulus and a flow passage for passing fluid from the interior bore of said tubular housing to the well annulus surrounding said apparatus;

a rubber skirt around the periphery of said tubular housing over said flow passage radially extensible outwardly for opening said flow passage and passing fluid from the interior bore of said tubular housing to the well annulus when the pressure in the interior bore exceeds the pressure in the well annulus;

inner sliding mandrel means in said tubular housing having a reduced portion exposed to pressure admitted between said tubular housing and said inner sliding mandrel means by said power pressure port, and arranged to move from a first position opening the inner end of said flow passage to a second position sealing closed the inner end of said flow passage when the well annulus pressure exceeds the interior bore pressure; and delay means for delaying movement of said inner sliding mandrel means from said first position to said second position.

7. The apparatus of claim 6 wherein said apparatus s an oil filled chamber between said tubular housing d said inner sliding mandrel means, and said delay eans comprises:

an annular piston around the periphery of said inner sliding mandrel means dividing said oil filled chamber;

metering means in said annular piston for transferring at a metered rate, oil from one side of said annular piston to the other side as said sliding mandrel means moves away from said first position toward said second position;

bypass means for bypassing oil around said metering means when said sliding mandrel moves away from said second position toward said first position; and spring means for urging said sliding mandrel means away from said second position toward said first position.

8. The apparatus of claim 7 further comprising locking means for locking said sliding mandrel means in said second position subsequent to the sliding mandrel means moving to the second position.

9. A method of testing an earth formation intersected by a borehole extending from the surface comprising:

a. setting a production packer in the borehole above the formation to be tested;

b. lowering into the borehole, a testing string having a flow passage throughout its length, a seal assembly for engagement with the packer, an apparatus above said seal assembly including a check valve for passing fluid flow from said flow passage to the well annulus and for blocking fluid flow from the well annulus to the flow passage, and a blocking means responsive to well annulus pressure increases for sealingly blocking access to said check valve from the flow passage;

c. engaging the seal assembly with the packer for forming a fluid tight seal above the formation to be tested and separating the formation from the well annulus above the packer;

d. further lowering the test string for seating the seal assembly in the packer;

e. responsive to fluid pressure increases in said flow passage during the further lowering step, opening said check valve through the walls of the testing string above the packer for relieving the pressure increases in the flow passage;

f. determining at the surface the location of hanging means for supporting the weight of the testing string in the well bore with the sealing assembly engaged with the packer without undue weight being applied to the packer;

g. withdrawing the testing string from the borehole a sufficient distance to install said hanging means;

h. during said withdrawing step, controlling the rate of blocking of access to said check valve by said blocking means a sufficient time to allow disengagement of said sealing means from said packer before access to said check valve is sealingly blocked;

i. installing said hanging means in said testing string;

j. repeating steps b. through e. for hanging said testing string from said hanging means with said sealing means sealingly engaged with said packer;

k. increasing the well annulus pressure to operate annulus pressure responsive tools in said testing string; and l. maintaining said well annulus pressure increase a sufficient length of time to sealingly block access to said check valve means by said blocking means responsive to the elevated well annulus pressure.

10. The method of claim 9 further comprising the steps of:

m. locking the blocking means in the closed position sealing access to the check valve; and n. pumping material down the flow passage in the testing string for treating the formation to be tested.

* * * * *